United States Patent [19]

Berry

[11] 4,222,566

[45] Sep. 16, 1980

[54] GOLF PUTTER

[76] Inventor: Troy R. Berry, 4924 Pershing, Fort Worth, Tex. 76107

[21] Appl. No.: 936,827

[22] Filed: Aug. 25, 1978

[51] Int. Cl.[3] ..... A63B 53/08

[52] U.S. Cl. ..... 273/164; 273/80.8; 273/169

[58] Field of Search ..... 273/163 R, 163 A, 164, 273/167 R, 167 A, 167 C, 167 D, 167 F, 167 G, 167 J, 169–173, 80.8, 174

[56] References Cited

U.S. PATENT DOCUMENTS

| | | | |
|---|---|---|---|
| Re. 19,178 | 5/1934 | Spiker | 273/164 |
| 1,291,967 | 1/1919 | McDougal | 273/163 R |
| 3,399,898 | 9/1968 | Burkland | 273/164 |
| 3,595,582 | 7/1971 | Chapman | 273/164 X |
| 3,866,922 | 2/1975 | Marci et al. | 273/167 F X |
| 3,873,094 | 3/1975 | Sebo et al. | 273/163 R |
| 4,077,633 | 3/1978 | Studen | 273/169 X |

FOREIGN PATENT DOCUMENTS

| | | | |
|---|---|---|---|
| 204652 | 10/1923 | United Kingdom | 273/164 |
| 310209 | 4/1929 | United Kingdom | 273/163 R |

*Primary Examiner*—Charles E. Phillips
*Attorney, Agent, or Firm*—James E. Bradley

[57] ABSTRACT

A golf putter having an improved head. The head includes a transparent rod secured perpendicular to the shaft. The rod has a flat bottom surface in which a slot has been formed. A lead weight is secured inside the slot. The weight has markings formed on its surface that are visible through the upper surface of the transparent member. The markings are brightly colored and are of various designs to aid in alignment.

1 Claim, 5 Drawing Figures

GOLF PUTTER

BACKGROUND OF THE INVENTION

1. Field of the Invention

This invention relates in general to golf clubs and in particular to an improved putter head.

2. Description of the Prior Art

Numerous types of golf putters are known. Some of the types have indicators on their heads to aid in alignment. One such device, as shown in U.S. Pat. No. 2,929,631, has a small lens mounted to the upper surface of the putter head. Lines in two colors are located below the lens. The upper surface of the lens is corrugated so that when one is looking at the putter from directly above, then only one of the colors can be seen. When looking from another angle, the other color becomes visible. While this design and others known may be successful, improvements are desired.

SUMMARY OF THE INVENTION

It is a general object of this invention to provide an improved golf putter head.

It is a further object of this invention to provide an improved golf putter head that uses bright color patterns to focus the user's concentration.

It is a further object of this invention to provide an improved golf putter head that uses bright color patterns to focus the user's attention, and that also has a low center gravity.

In accordance with these objects, a golf putter head is provided that comprises a cylindrical transparent rod. The rod has a front striking surface, a curved top surface, and flat bottom. A slot is formed in the bottom and extends along the length of the rod. A lead weight having brightly colored markings painted thereon, is secured inside the slot. The markings are visible from above the putter. A curved upper surface accentuates the markings, making them appear to extend transversely completely across the putter. The center of gravity of the putter head is located in the weight, which is much denser than the transparent rod. Since the weight is located in the lower part of the head, the center of gravity of the putter head is below the center line of the putter.

DESCRIPTION OF THE PREFERRED EMBODIMENT

Figure 1:
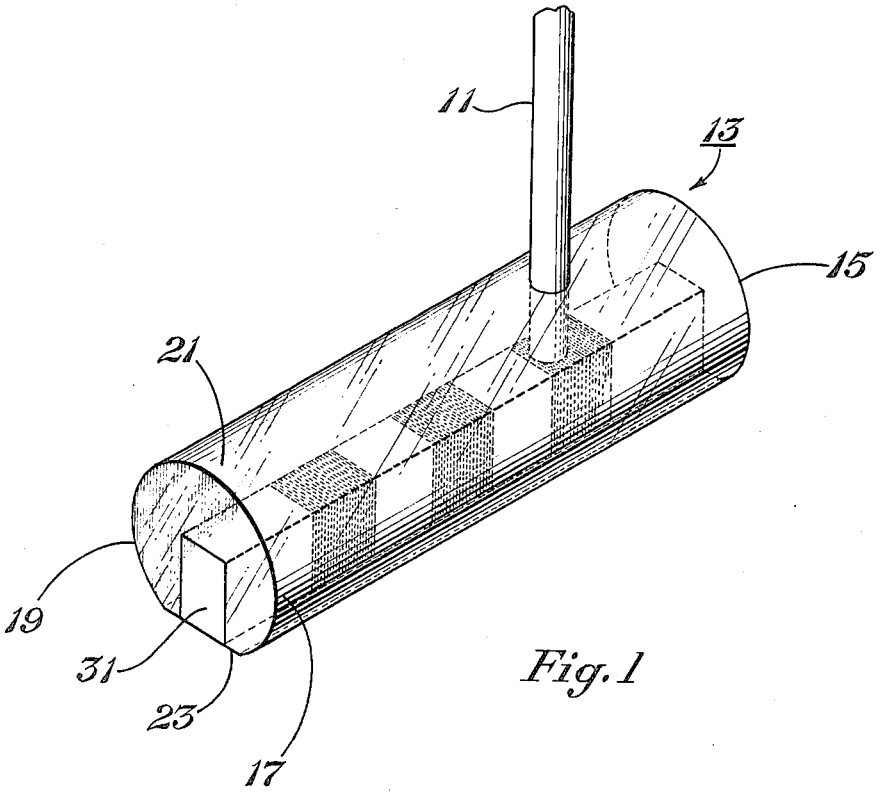
FIG. 1 is a perspective view of a golf putter head constructed in accordance with this invention.
Figure 2:
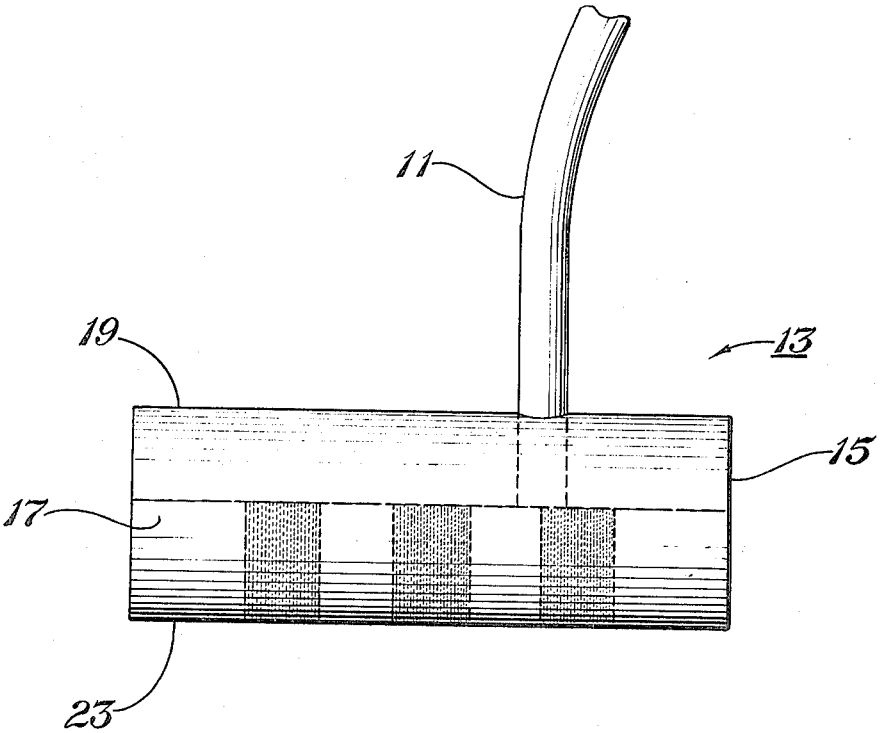
FIG. 2 is a front elevational view of the golf putter head of FIG. 1.

Referring to FIGS. 1–4, a portion of a golf club putter is shown, including its shaft 11 and putter head 13. Shaft 11 extends generally upward and has a handle (not shown) for being gripped.

Putter head 13 comprises a solid transparent, elongated member or rod 15 of acrylic. Rod 15 has a front striking surface 17, a rear surface 19, a top surface 21, and a bottom surface 23. For left-handed putters, the front and rear surfaces 17, 19 are reversed. In the embodiment of FIGS. 1–4, the front, top and rear surfaces are curved. The bottom surface 23 is flat and perpendicular to the shaft 11. As shown in FIG. 4, the configuration when viewed from one end is a solid cylinder, with a small segment removed to define the bottom surface 23, the bottom surface 23 being parallel with the longitudinal axis of the cylinder.

A line extending from the intersection of the front surface 17 with the bottom surface 23 and tangent to the front surface defines an obtuse angle of approximately 135° with respect to the bottom surface. The intersection of the rear surface 19 with the bottom surface 23 is identical to the front surface intersection.

Figure 3:
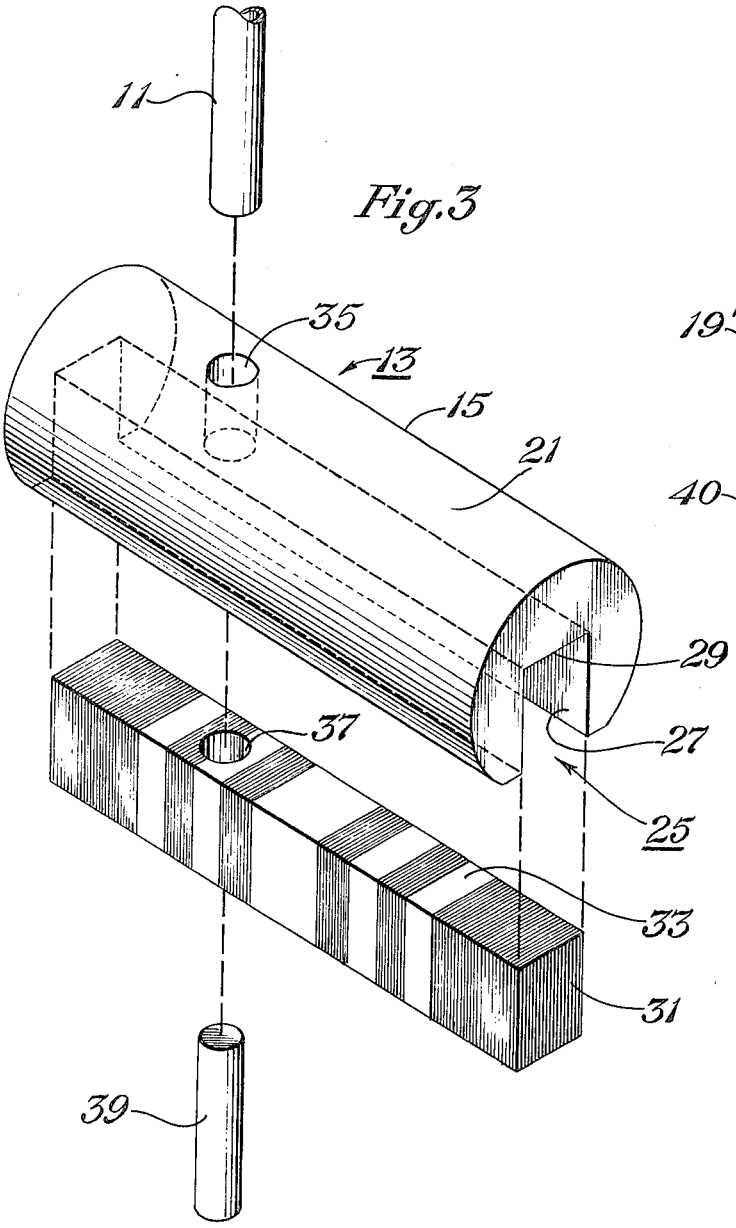
FIG. 3 is an exploded perspective view of the golf putter head of FIG. 1.
Figure 4:
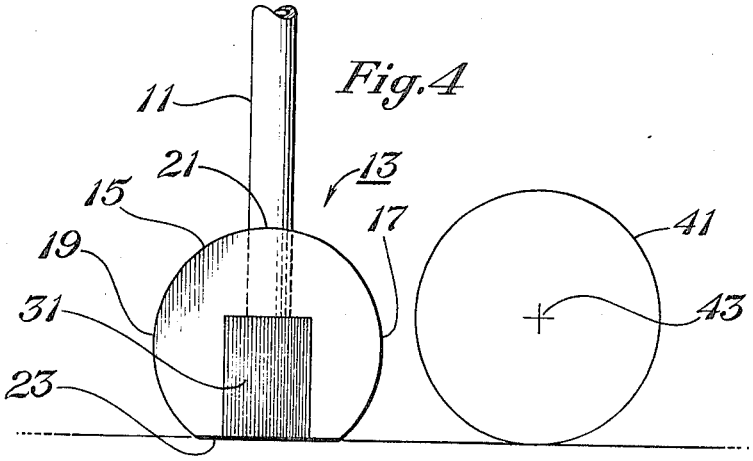
FIG. 4 is an end elevational view of the golf putter head of FIG. 1.

As shown in FIG. 3, a large rectangular slot 25 extends the full length of rod 15. Slot 25 extends upward from the bottom surface 23 for a distance greater than the radius of the rod 15. The width of slot 25 is about $\frac{7}{8}$ the diameter of rod 15. Slot 25 has two vertical walls 27 perpendicular to bottom surface 23, and a top horizontal wall 29 parallel with bottom surface 23. Slot 25 is open at both ends.

A metal weight 31, preferably lead, is secured inside slot 25. Weight 31 is an elongated rectangular rod with dimensions equal to slot 25 so as to completely fill it, with the ends flush with the ends of the rod 15 and the bottom flush with the bottom surface 23. Weight 31 has various markings or lines 33 painted on its upper, front and rear surfaces. These lines preferably are in two brightly contrasting colors alternating with each other. Although various patterns can be used for the lines 31, the lines 31 in the embodiments shown are all parallel to each other and normal to the striking surface 17.

As shown in FIG. 3, mating holes 35, 37 are formed in the rod 15 and weight 31 respectfully. Holes 35, 37 are perpendicular to bottom surface 23 and are located from one end of the rod about $\frac{7}{8}$ of its length. Shaft 11 is secured inside holes 35, 37 with an aid of a solid plug 39. Plug 39 is forced into the hollow shaft 11 in a tight interference fit to rigidly fasten it to the head 13. Adhesive is also used in securing the shaft 11 and weight 31 to the putter head 13.

Figure 5:
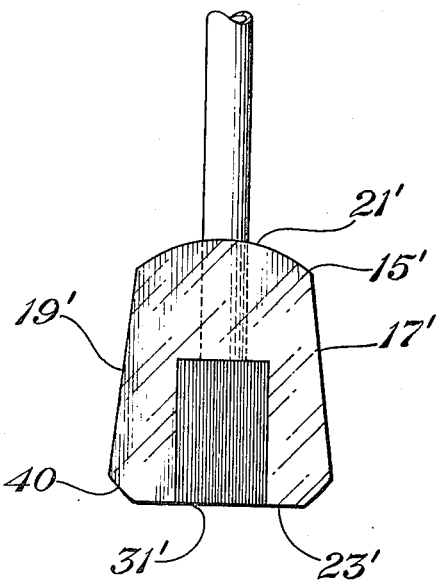
FIG. 5 is an end elevational view of an alternate embodiment of a golf putter head constructed in accordance with this invention.

The putter head embodiment of FIG. 5 is similar to the embodiment of FIGS. 1–4, having a transparent rod 15', with a curved top surface 21' and flat bottom surface 23'. The front striking surface 17' and the rear surface 19', however, are flat. Front and rear surfaces 17', 19' taper inwardly and upwardly at an angle of approximately 7° with respect to the vertical. The weight 31' is identical to weight 31 used in the embodiment of FIGS. 1–4. The intersections of the bottom surface 31' with the front or rear surfaces 17', 19' are bevelled, as indicated at numeral 40. Bevel 40 forms an obtuse angle of 135° with respect to the bottom surface 31'.

In operation, the putter head is used conventionally. The bright indicator lines assist in focusing one's attention and in alignment. As shown in FIG. 4, the height of the putter head 13 is selected so that its point of contact with a golf ball 41 is below the ball center 43. This occurs with either embodiment. The low point of contact imparts an overspin reaction at an earlier instance in the ball roll than with conventional putters.

The bevel 40 and curved front and rear surfaces 17, 19 avoid drag of the putter head against the putting green since the angles of intersection are obtuse. The curved top surfaces 21 and 21' provide a parallax effect when viewed from above. The lines appear to extend the full width of the rod 15, rather than just the width of the weight 31.

In both embodiments, the rods are preferably 4 inches long and $1\frac{3}{8}$ inch high. The holes for shaft 11 are approximately $1\frac{1}{4}$ inch from one end. The weights 31 and 31' are $\frac{1}{2}$ inch wide, $\frac{3}{4}$ inch high and 4 inches long, yielding approximately 0.6 pound of weight. In the embodiment of FIGS. 1–4, the rod is $1\frac{1}{2}$ inch in diameter, with the bottom surface 23 being formed by the removal of a $\frac{1}{8}$ inch high slice or segment. Since the acrylic is much lighter than lead, the center gravity of the putter head is substantially at the center of gravity of the weight, $\frac{3}{8}$ inch from the bottom.

It should be apparent that an invention having significant improvements has been provided. The bright contrasting lines, viewed through the top surface, focuses one's attention and aids in alignment. Placing the lead weight within an acrylic member allows weights of nonuniform shapes to be used, if desired, and provides a low center of gravity. The obtuse lower corners avoid drag, and the low contact point provides overspin at an early instance.

While the invention has been shown in only two of its forms, it should be apparent to those skilled in the art that it is not so limited but is susceptible to various changes and modifications without departing from the spirit thereof. For example, although in the preferred embodiment, the rod is clear or free of color, the word "transparent" is considered herein to include tinted material, so long as the lines on the weight are clearly visible through the top surface when viewed from above.

I claim:

1. A golf putter having a shaft and an improved head secured to the shaft, the head comprising:

an elongated transparent member secured perpendicularly to the shaft, having a front striking surface on one side, a rear surface, a top surface that is a cylindrical segment with an axis perpendicular to the shaft and parallel to the front striking surface, and a substantially flat bottom surface perpendicular to the shaft, the bottom surface having a slot formed therein that extends substantially the length of the putter, the intersections of the bottom surface with the front surface and rear surface being at an obtuse angle with respect to the bottom surface; and a rectangular metal weight of the same size as the slot, the weight having a substantially flat bottom surface fitting flush with the bottom surface of the transparent member and having contrasting colored lines on its upper surace that are visible from above through the top surface of the transparent member for aiding in alignment;

the top surface of the transparent member creating a parallax effect when viewed from above, causing the markings on the weight to appear to be the full width of the transparent member.

* * * * *